US009750113B2

(12) United States Patent
Nozawa et al.

(10) Patent No.: US 9,750,113 B2
(45) Date of Patent: Aug. 29, 2017

(54) DRIVING CIRCUIT OF LIGHT SOURCE AND CONTROL CIRCUIT THEREOF, DRIVING METHOD OF LIGHT SOURCE, LIGHTING APPARATUS, AND ELECTRONIC DEVICE

(71) Applicant: ROHM CO., LTD., Ukyo-ku, Kyoto (JP)

(72) Inventors: Takeshi Nozawa, Kyoto (JP); Shingo Haruta, Kyoto (JP)

(73) Assignee: ROHM CO., LTD., Ukyo-ku, Kyoto (JP)

( * ) Notice: Subject to any disclaimer, the term of this patent is extended or adjusted under 35 U.S.C. 154(b) by 0 days.

(21) Appl. No.: 15/139,663

(22) Filed: Apr. 27, 2016

(65) Prior Publication Data

US 2016/0323954 A1 Nov. 3, 2016

(30) Foreign Application Priority Data

May 1, 2015 (JP) ..... 2015-094313

(51) Int. Cl.
*H05B 37/00* (2006.01)
*H05B 37/02* (2006.01)
(Continued)

(52) U.S. Cl.
CPC ..... *H05B 37/0254* (2013.01); *H05B 33/086* (2013.01); *G09G 3/3406* (2013.01)

(58) Field of Classification Search
CPC ..... G02F 1/1336; G02F 1/133609; H05B 33/0845; H05B 33/0818; H05B 33/0827;
(Continued)

(56) References Cited

U.S. PATENT DOCUMENTS

2010/0026208 A1* 2/2010 Shteynberg ..... H05B 33/0815 315/297
2011/0187283 A1* 8/2011 Wang ..... H05B 37/02 315/291

(Continued)

FOREIGN PATENT DOCUMENTS

JP 2003153529 A 5/2003
JP 2004047538 A 12/2004

OTHER PUBLICATIONS

Intruduction to Pulse Width Modulation (PWM), Mar. 29, 2012, Michael Barr.*

*Primary Examiner* — Douglas W Owens
*Assistant Examiner* — Wei Chan
(74) *Attorney, Agent, or Firm* — Cantor Colburn LLP

(57) ABSTRACT

A control circuit of a driving circuit for supplying a driving current to a light source includes: a pulse width modulation (PWM) input terminal configured to receive an input dimming pulse having an input duty ratio corresponding to a target light quantity of the light source, the input dimming pulse being pulse-width modulated; and a dimming controller configured to convert a period and a pulse width of the input dimming pulse into digital values, reconvert the digital values into an output dimming pulse having an output duty ratio which is the same as or different from the input duty ratio, and control the driving current to be on and off based on the output dimming pulse.

19 Claims, 13 Drawing Sheets

(51) Int. Cl.
*H05B 33/08* (2006.01)
*G09G 3/34* (2006.01)

(58) Field of Classification Search
CPC .... H05B 33/0815; H05B 37/00; H05B 37/02; H05B 33/08; Y02B 20/341; Y02B 20/345
USPC ..... 315/318, 294, 297, 312, 360, 169.2, 315/185 R, 169.1–169.3, 307, 36
See application file for complete search history.

(56) References Cited

U.S. PATENT DOCUMENTS

2012/0188487 A1* 7/2012 Hagino ..... H05B 33/0812 349/69
2013/0147369 A1* 6/2013 Zhang ..... H05B 33/0821 315/185 R

* cited by examiner

DRIVING CIRCUIT OF LIGHT SOURCE AND CONTROL CIRCUIT THEREOF, DRIVING METHOD OF LIGHT SOURCE, LIGHTING APPARATUS, AND ELECTRONIC DEVICE

CROSS-REFERENCE TO RELATED APPLICATION

This application is based upon and claims the benefit of priority from Japanese Patent Application No. 2015-094313, filed on May 1, 2015, the entire contents of which are incorporated herein by reference.

TECHNICAL FIELD

The present disclosure relates to a driving circuit of a light source.

BACKGROUND

Semiconductor light sources such as light emitting diodes (LEDs) as a liquid crystal backlight or a lighting device have become prevalent. FIG. 1 is a circuit diagram of a driving circuit of an LED. The driving circuit (LED driver 90R) includes a constant current converter 100R and a control circuit 300R. The constant current converter 100R receives an input voltage $V_{IN}$ from a power source (not shown) by an input line 104 and boosts the received voltage $V_{IN}$ to supply an output voltage $V_{OUT}$ to an LED light source 502 as a load connected to an output line 106 and also stabilize a current (a load current or a driving current) $I_{LED}$ flowing in the LED light source 502 to a target value $I_{REF}$. For example, the LED light source 502 is an LED string.

The constant current converter 100R is, for example, a boost converter, and includes a smoothing capacitor C1, a rectifying diode D1, a switching transistor M1, an inductor L1, and a detection resistor $R_{CS}$.

As a method for changing a quantity of light (brightness) of the LED light source 502, analog dimming and pulse width modulation (PWM) dimming have been known. FIG. 2 is a waveform view illustrating analog dimming and PWM dimming.

The analog dimming changes the amplitude (current amount) of the driving current $I_{LED}$. For the analog dimming, an error amplifier 304 and a duty controller 306 are provided. The current $I_{LED}$ flowing in the LED light source 502 flows into the detection resistor $R_{CS}$ to generate a voltage drop in proportion to the current $I_{LED}$ of the detection resistor $R_{CS}$. The voltage drop as a detection voltage $V_{CS}$ is input to a current detection (CS) terminal of the control circuit 300R. An analog dimming voltage $V_{ADIM}$ representing the target value $I_{REF}$ of the load current $I_{LED}$ from an external host processor 400 is input to an analog dimming (ADIM) terminal of the control circuit 300R. The control circuit 300R generates a driving pulse $S_{DRV}$ whose duty ratio is adjusted such that the detection voltage $V_{CS}$ is identical to the analog dimming voltage $V_{ADIM}$, and drives a switching transistor M1.

The error amplifier 304 amplifies an error between the detection voltage $V_{CS}$ and the analog dimming voltage $V_{ADIM}$ to generate a feedback signal $V_{FB}$ corresponding to the error. For example, the error amplifier 304 includes a transconductance amplifier (gm amplifier), and a resistor $R_{FB}$ and a capacitor $C_{FB}$ for phase compensation connected to an output thereof. The duty controller 306 is a so-called pulse modulator, and generates the driving pulse $S_{DRV}$ having a duty ratio based on the feedback signal $V_{FB}$. The driver 308 switches the switching transistor M1 according to the driving signal $S_{DRV}$.

In this constant current converter 100R, the feedback signal $V_{FB}$ is applied such that the following relational expression is established.

$$I_{LED} \times R_{CS} = V_{ADIM}$$

Thus, the load current $I_{LED}$ is stabilized to the target current amount $I_{REF}$ which is in proportion to the analog dimming voltage $V_{ADIM}$.

Next, the PWM dimming will be described. In the PWM dimming, an effective light quantity is changed by changing the illumination time of the LED light source 502. A dimming pulse $S_{PWMIN}$ from the host processor 400 is input to a PWMIN terminal. The dimming pulse $S_{PWMIN}$ has a duty ratio corresponding to a target light quantity of the LED light source 502. A driver 330 switches a PWM dimming switch M2 according to the dimming pulse $S_{PWMIN}$.

Jitter is superimposed on the dimming pulse $S_{PWMIN}$ generated by the host processor 400. As illustrated in FIG. 2, a timing of a positive edge/negative edge of the dimming pulse $S_{PWMIN}$ is fluctuated randomly or periodically on the time axis due to the jitter, causing an error of the duty ratio (pulse width). When a duty ratio is large so the brightness of the LED light source 502 is high, the influence of the jitter may be neglected. However, when the duty ratio is small so the brightness of the LED light source 502 is low, the fluctuation of brightness resulting from the jitter, that is, flickering, is visible to human beings. In particular, since the eyes of humans have logarithmic sensitivity, low brightness and a small fluctuation in brightness may be easily recognized.

Further, in order to solve this problem, it is necessary to increase the clock accuracy of the host processor 400 for generating the dimming pulse $S_{PWMIN}$, but in this case, costs are increased. Here, the jitter is taken as an example as a factor of flickering, but flickering may also occur due to other factors, for example, noise. This problem must not be recognized by a range of common general knowledge in the art to which the present disclosure pertains, and it is recognized by the inventor of the present disclosure independently.

SUMMARY

The present disclosure provides some embodiments of a reduction in flickering of PWM dimming.

According to one embodiment of the present disclosure, there is provided a control circuit of a driving circuit for supplying a driving current to a light source. The control circuit includes a pulse width modulation (PWM) input terminal configured to receive an input dimming pulse having an input duty ratio corresponding to a target light quantity of the light source and which is pulse-width modulated; and a dimming controller configured to convert a period and a pulse width of the input dimming pulse into digital values, reconvert the digital values into an output dimming pulse having an output duty ratio which is the same as or different from the input duty ratio, and control ON/OFF of the driving current based on the output dimming pulse.

According to this embodiment, it is possible to first convert the period and the pulse width of the input dimming pulse from the outside into digital values and then correct the output duty ratio as necessary, thereby suppressing the fluctuation in the duty ratio of the PWM dimming to reduce flickering.

In some embodiments, the dimming controller may include a measurement part configured to measure the period and the pulse width of the input dimming pulse to generate period data representing the period and input duty ratio data representing the pulse width; a correction part configured to generate output duty ratio data based on the input duty ratio data; and a reconversion part configured to generate the output dimming pulse based on the period data and the output duty ratio data.

The pulse width may have a section of a high level or a section of a low level.

In some embodiments, one of (i) the previous output duty ratio data and (ii) the input duty ratio data may be selected as the output duty ratio data.

When a change in the input duty ratio is highly likely to result from jitter or noise, the current input duty ratio data is neglected by setting the output duty ratio data to the previous output duty ratio data, thereby suppressing the fluctuation in the output duty ratio data.

In some embodiments, the correction part may include a memory configured to hold the previous output duty ratio data as reference duty ratio data, and may be configured to generate the output duty ratio data based on a result of comparison between the input duty ratio data and the reference duty ratio data.

Thus, it is possible to determine whether a change in input duty ratio data is resulted from intentional controlling or from the influence of jitter, noise, or the like.

The correction part may be configured to (i) maintain the output duty ratio data when the number of times of occurrence of the input duty ratio data that satisfies a predetermined condition regarding the reference duty ratio data is satisfied is smaller than a predetermined number of times, and (ii) update the memory based on the input duty ratio data by setting the input duty ratio data as new output duty ratio data when the number of times of occurrence exceeds the predetermined number of times.

In some embodiments, the predetermined condition may be that the input duty ratio data is smaller than the reference duty ratio data. Alternatively, the predetermined condition may be that the input duty ratio data is smaller than the reference duty ratio data by a predetermined value or greater.

The correction part may be configured to set (iii) the input duty ratio data as the new output duty ratio data when the input duty ratio data is greater than the reference duty ratio data.

The correction part may be configured to (iii-1) set the input duty ratio data as the new output duty ratio data when the input duty ratio data is greater than the reference duty ratio data and a difference between the reference duty ratio data and the input duty ratio data is greater than a first threshold value, and (iii-2) maintain the output duty ratio data when the input duty ratio data is greater than the reference duty ratio data and the difference is smaller than the first threshold value.

It is possible to adjust the sensitivity to jitter or noise based on the first threshold value.

In some embodiments, the predetermined condition may be that the input duty ratio data is greater than the reference duty ratio data. Alternatively, the predetermined condition may be that the input duty ratio data is greater than the reference duty ratio data by a predetermined value or greater.

The correction part may be configured to set (iii) the input duty ratio data as the new output duty ratio data when the input duty ratio data is smaller than the reference duty ratio data.

The correction part may be configured to (iii-1) set the input duty ratio data as the new output duty ratio data when the input duty ratio data is smaller than the reference duty ratio data and a difference between the reference duty ratio data and the input duty ratio data is greater than a first threshold value, and (iii-2) maintain the output duty ratio data when the input duty ratio data is smaller than the reference duty ratio data and the difference is smaller than the first threshold value.

It is possible to adjust the sensitivity to jitter or noise based on the first threshold value.

In some embodiments, the control circuit may further include a first register configured to store first data for setting the predetermined number of times. Thus, it is possible to set an optimal value for each platform on which the control circuit is used.

The control circuit may further include a second register configured to store second data for setting the first threshold value. Thus, it is possible to set an optimal value for each platform on which the control circuit is used.

When the duty ratio is large to a degree so the light source emits light brightly, it is difficult for a change in the duty ratio of PWM dimming to be recognized as flickering. Thus, when the duty ratio of the input dimming pulse is greater than a predetermined second threshold value, the dimming controller may not perform correction.

The control circuit may further include a third register configured to store third data for setting the second threshold value. Thus, it is possible to set an optimal value for each platform on which the control circuit is used.

The driving circuit may include a constant current converter. The control circuit may further include a feedback controller configured to control the constant current converter.

In some embodiments, the control circuit may be integrated on a single semiconductor substrate.

The term "integrated" may include a case in which all the components of a circuit are formed on a semiconductor substrate or a case in which major components of a circuit are integrated, and some resistors, capacitors, or the like may be installed outside the semiconductor substrate in order to adjust circuit constants.

According to another embodiment of the present disclosure, there is provided a driving circuit of a light source. The driving circuit includes a constant current converter; and any one of the control circuits described above.

According to still embodiment of the present disclosure, there is provided a lighting apparatus. The lighting apparatus may include a lighting emitting diode (LED) light source including a plurality of LEDs connected in series; a rectifying circuit configured to smooth and rectify a commercial AC voltage; a constant current converter configured to receive a DC voltage smoothed and rectified by the rectifying circuit as an input voltage and set the LED light source as a load; and any one of the control circuits described above.

According to a further embodiment of the present disclosure, there is provided an electronic device. The electronic device may include a liquid crystal panel; and the lighting apparatus as described above, which is a backlight configured to irradiate the liquid crystal panel from a back surface thereof.

Further, arbitrarily combining the foregoing components or converting the expression of the present disclosure among a method, an apparatus, and the like is also effective as an embodiment of the present disclosure.

DETAILED DESCRIPTION

Figure 1:
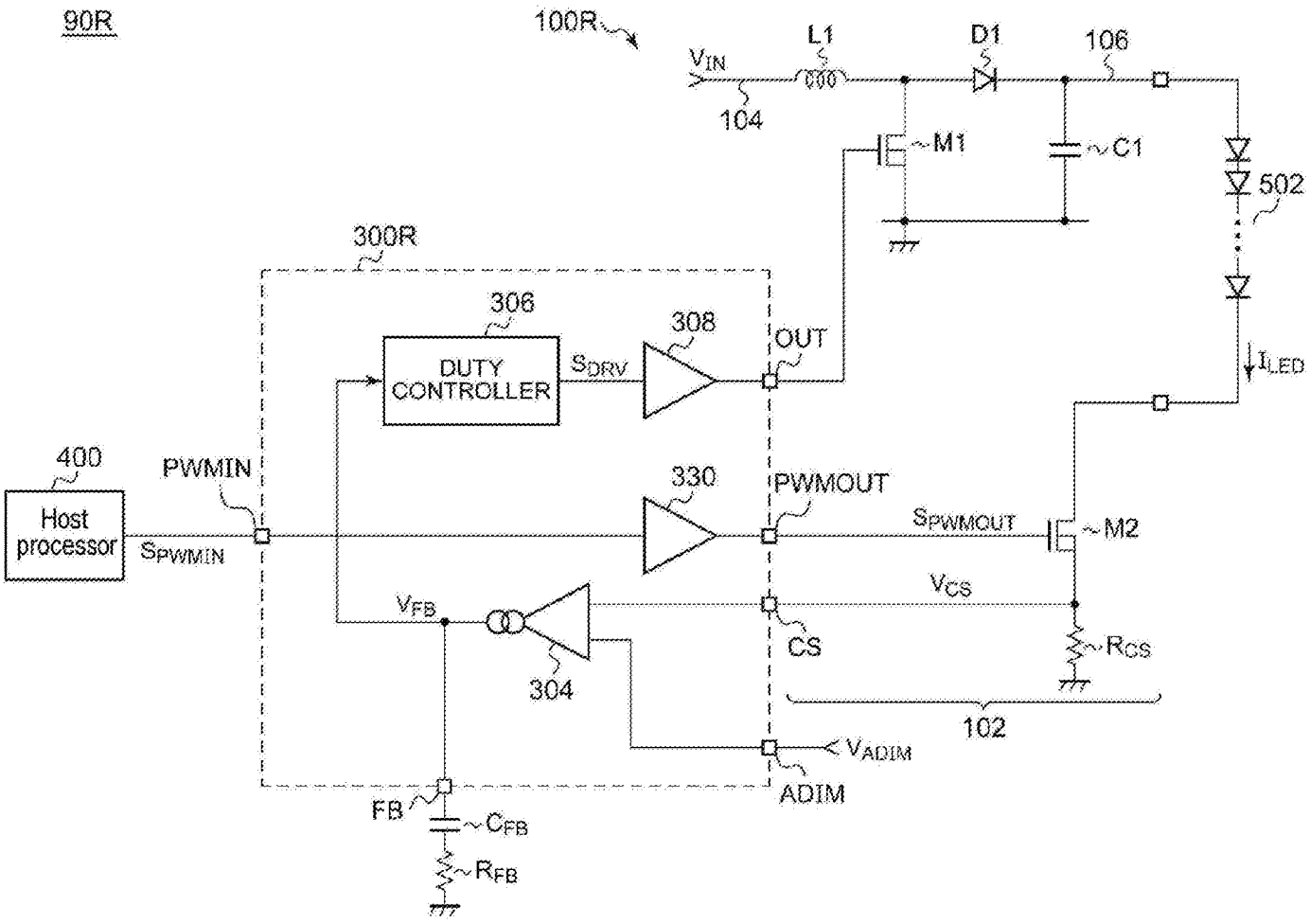
FIG. 1 (Related Art)
FIG. 1 is a circuit diagram of a driving circuit of an LED.
Figure 2:
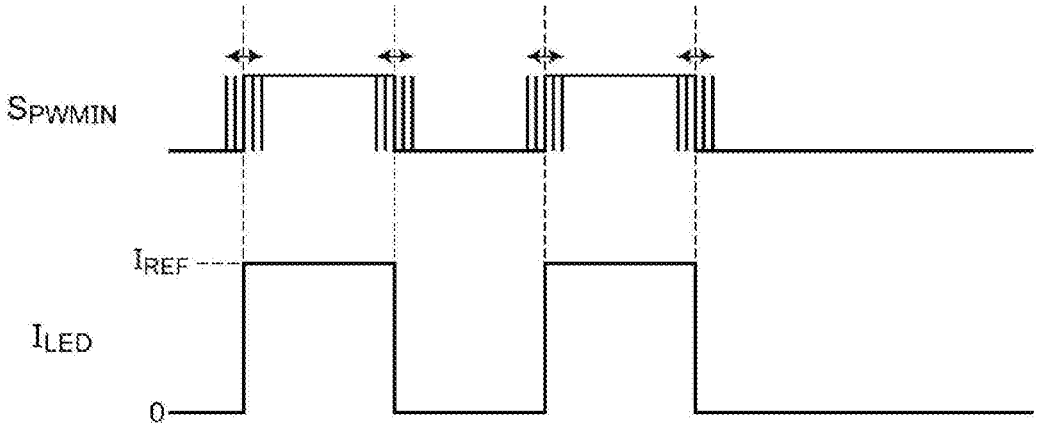
FIG. 2 (Related Art)
FIG. 2 is a waveform view illustrating analog dimming and PWM dimming.

Embodiments of the present disclosure will be now described in detail with reference to the drawings. Like or equivalent components, members, and processes illustrated in each drawing are given like reference numerals and a repeated description thereof will be properly omitted. Further, the embodiments are presented by way of example only, and are not intended to limit the present disclosure, and any feature or combination thereof described in the embodiments may not necessarily be essential to the present disclosure.

In the present disclosure, "a state where a member A is connected to a member B" includes a case where the member A and the member B are physically directly connected or even a case in which the member A and the member B are indirectly connected through any other member that does not affect an electrical connection state thereof.

Similarly, "a state where a member C is installed between a member A and a member B" also includes a case where the member A and the member C or the member B and the member C are indirectly connected through any other member that does not affect an electrical connection state, in addition to a case in which the member A and the member C or the member B and the member C are directly connected.

Figure 3:
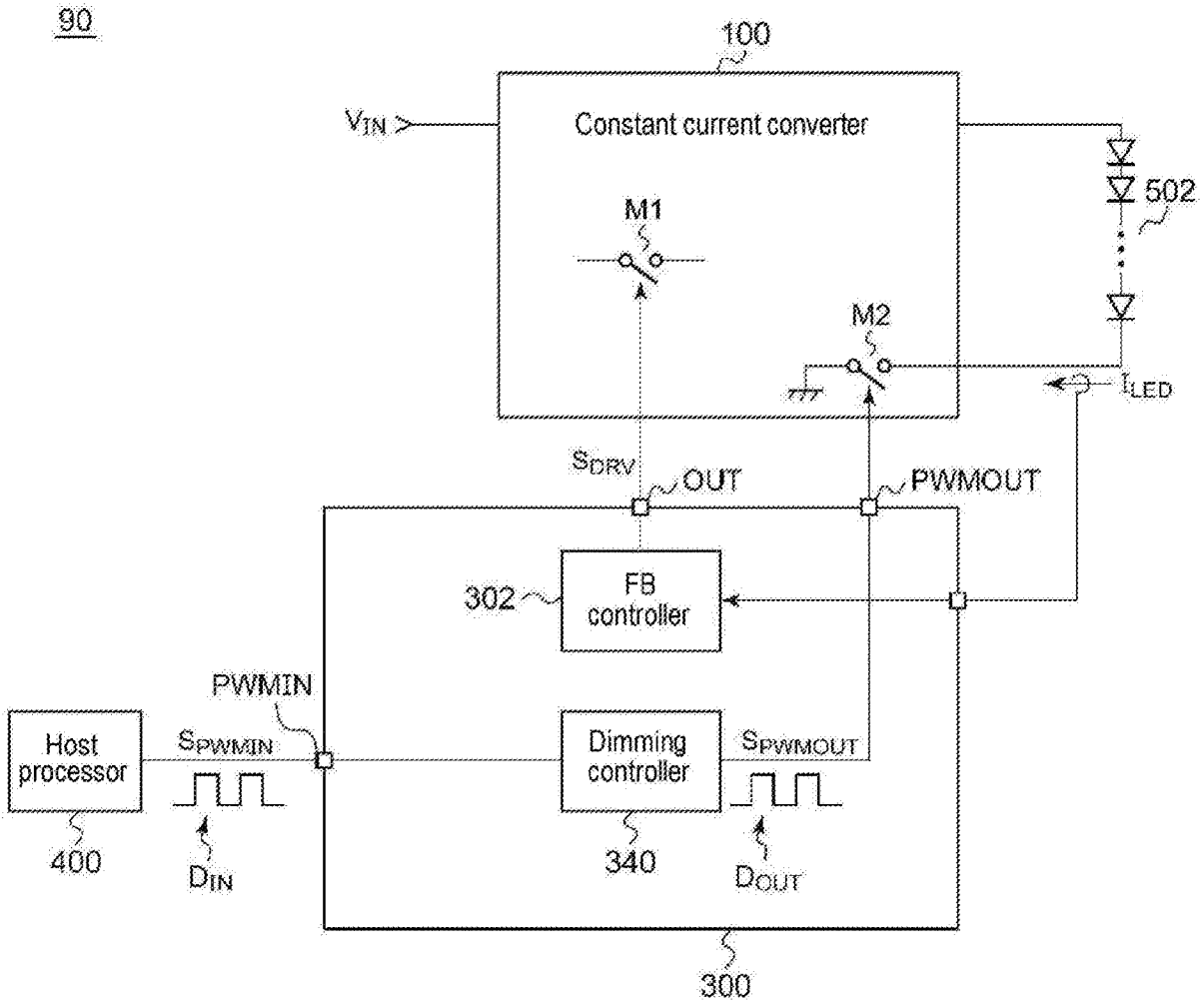
FIG. 3 is a block diagram of a driving circuit of a light source according to an embodiment.

FIG. 3 is a block diagram of a driving circuit of a light source according to an embodiment of the present disclosure. A driving circuit (hereinafter, referred to as an LED driver) 90 mainly includes a constant current converter 100 for supplying a driving current $I_{LED}$ to an LED light source 502 and a control circuit 300.

The LED light source 502 may be an LED string including a plurality of light emitting devices (LEDs) connected in series. The constant current converter 100 supplies a driving current $I_{LED}$ stabilized to a target current $I_{REF}$ corresponding to a target brightness to the LED light source 502.

The constant current converter 100 may be a step-up converter, a step-down converter, a step-up/step-down converter, a flyback converter, a forward converter, or the like, and a configuration thereof is not particularly limited.

The constant current converter 100 steps up or steps down an input voltage $V_{IN}$ of an input line 104 to generate an output voltage $V_{OUT}$ between both ends of the LED light source 502.

The control circuit 300, which is a functional integrated circuit (IC) integrated on a single semiconductor substrate, feedback-controls the constant current converter 100 and also switches ON/OFF of the driving current $I_{LED}$ to perform PWM dimming.

The control circuit 300 includes an output (OUT) terminal, a PWM input (PWMIN) terminal, and a PWM output (PWMOUT) terminal. The OUT terminal is connected to a switching transistor M1 of the constant current converter 100.

The control circuit 300 mainly includes a feedback controller 302 and a dimming controller 340. The feedback controller 302 generates a driving pulse $S_{DRV}$ whose duty ratio is adjusted such that the driving current $I_{LED}$ supplied to the LED light source 502 is constant, and switches the switching transistor M1 according to the driving pulse $S_{DRV}$.

A control mode of the feedback controller 302 is not particularly limited, but may use any other known scheme such as a voltage mode, a peak current mode, an average current mode, or a hysteresis (Bang-Bang) control. Further, the configuration of the feedback controller 302 is not limited, but may be determined according to the control mode.

An input dimming pulse $S_{PWMIN}$ having an input duty ratio $D_{IN}$ corresponding to a target light quantity of the LED light source 502 from a host processor 400 is input to the PWMIN terminal. The dimming controller 340 may turn on or turn off the LED light source 502 at a high speed by controlling ON/OFF of the driving current $I_{LED}$ according to the input dimming pulse $S_{PWMIN}$.

The dimming controller 340 reconverts a period $T_P$ and a pulse width $T_{ON}$ of the input dimming pulse $S_{PWMIN}$ into digital values and converts the digital values into an output dimming pulse $S_{PWMOUT}$ having an output duty ratio $D_{OUT}$ which is the same as or different from the input duty ratio $D_{IN}$.

The dimming controller 340 may control a PWM dimming switch M2 according to the output dimming pulse $S_{PWMOUT}$. Further, the PWM dimming switch M2 is not necessarily essential, and the switching transistor M1 may serve as the PWM dimming switch M2 in a so-called step-down LED driver.

Figure 4A:
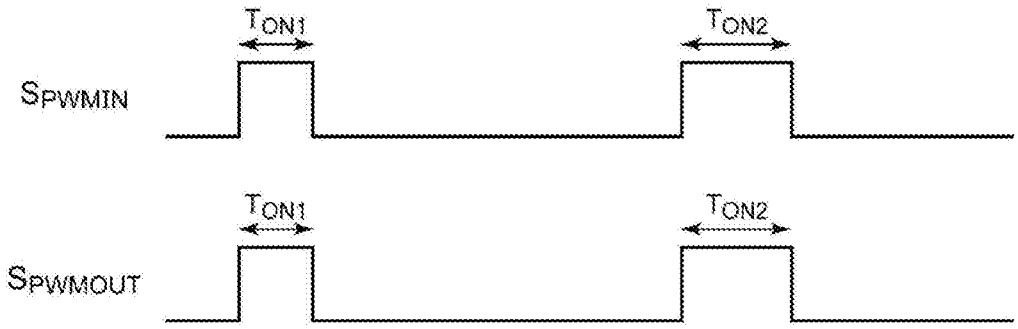
FIGS. 4A and 4B are operational waveform views of a control circuit.
Figure 4B:
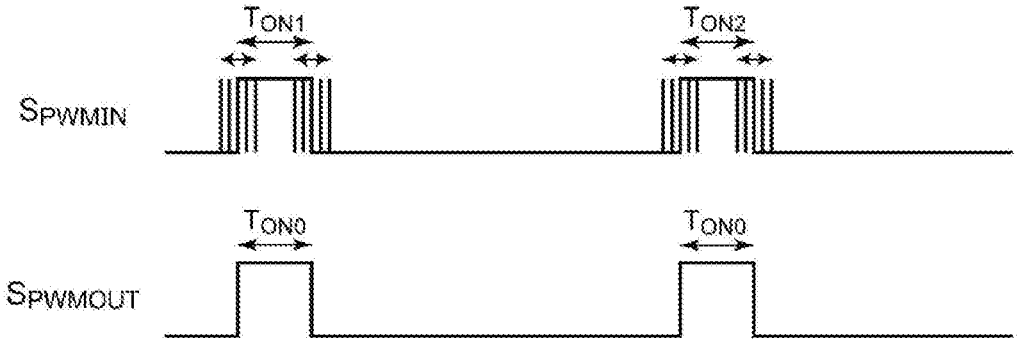

The configuration of the control circuit 300 has been described above. Next, an operation thereof will be described. FIGS. 4A and 4B are operational waveform views of the control circuit 300. FIG. 4A illustrates an operation when jitter and noise are not included in the input dimming pulse $S_{PWMIN}$. In this case, a pulse width (duty ratio) of the output dimming pulse $S_{PWMOUT}$ is the same as that of the input dimming pulse $S_{PWMIN}$.

FIG. 4B illustrates an operation when jitter and noise are included in the input dimming pulse $S_{PWMIN}$. In this case, a pulse width (duty ratio) of the output dimming pulse $S_{PWMOUT}$ has a value $T_{ON0}$, which is unrelated to that of the input dimming pulse $S_{PWMIN}$. In other words, an output duty ratio $D_{OUT}$ has been corrected. The value $T_{ON0}$ is desirable in many cases since a pulse width measured in the past may be used.

The operation of the control circuit 300 has been described above. The control circuit 300 may first convert the period $T_P$ and the pulse width $T_{ON}$ of the input dimming pulse $S_{PWMIN}$ from the outside into digital values, and then correct the output duty ratio $D_{OUT}$ (pulse width) as necessary, thereby suppressing the fluctuation in the duty ratio of the PWM dimming to reduce flickering.

The present disclosure is recognized by the block diagram and circuit diagram of FIG. 3, and encompasses various devices and circuits derived from the above description, and is not limited to a specific configuration. Hereinafter, a specific configuration example will be described in order to facilitate and clarify understanding of the essence and circuitry operation of the disclosure, rather than to narrow the scope of the present disclosure.

Figure 5:
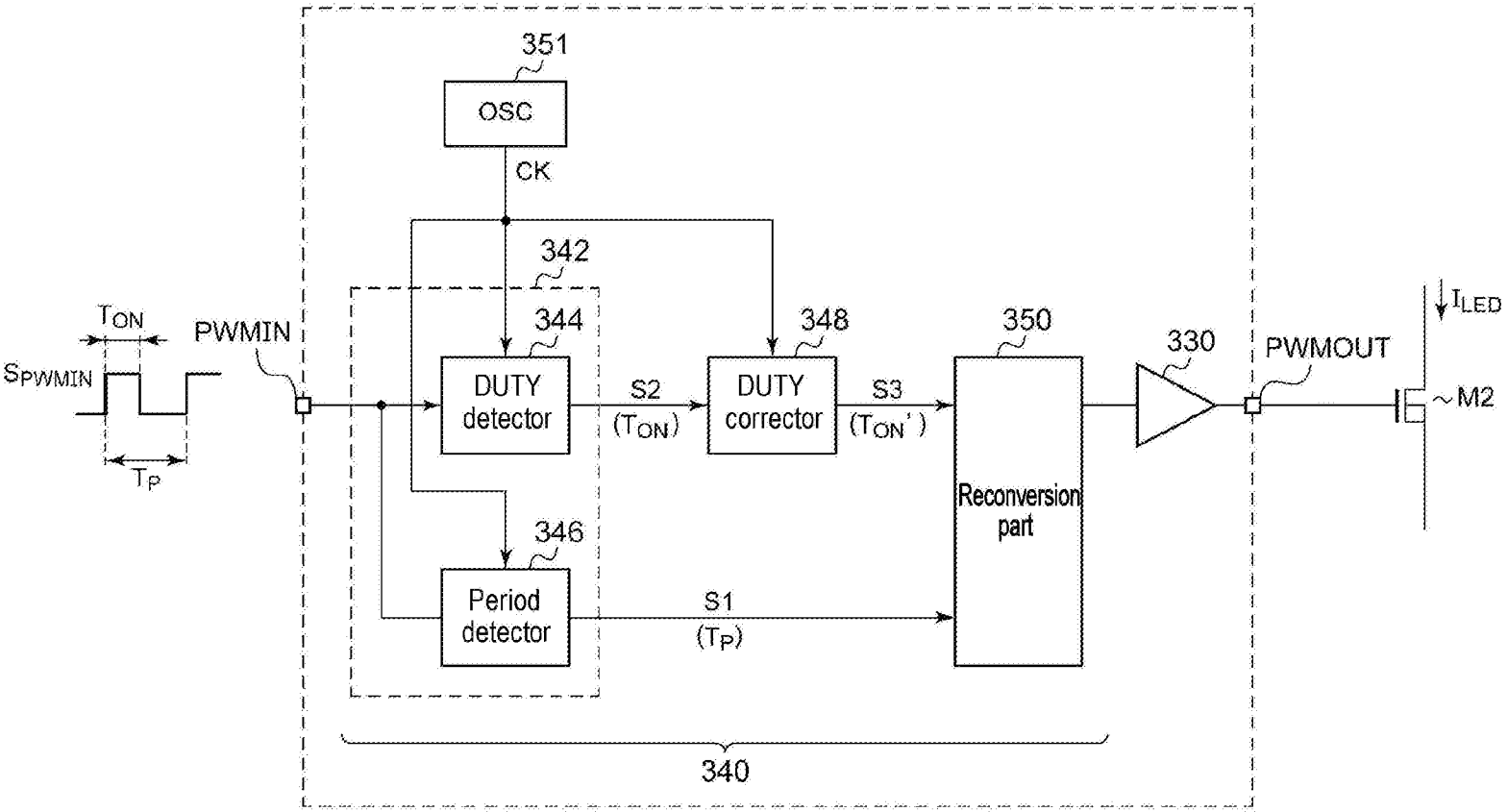
FIG. 5 is a block diagram illustrating a dimming controller.

FIG. 5 is a block diagram illustrating the dimming controller 340. The dimming controller 340 includes a measurement part 342, a correction part 348, a reconversion part 350, and a driver 330.

The measurement part 342 measures a period $T_P$ and a pulse width $T_{ON}$ of an input dimming pulse $S_{PWMIN}$ to generate period data S1 representing the period $T_P$ and input duty ratio data S2 representing the pulse width $T_{ON}$.

A duty ratio detector 344 may be configured as a digital counter for measuring the pulse width $T_{ON}$ of the input dimming pulse $S_{PWMIN}$, in other words, a duty ratio, using a sufficiently fast clock CK generated by an oscillator 351. In this case, the input duty ratio data S2 is a count value, and S2=$T_{ON}/T_{CK}$. Here, $T_{CK}$ is a clock period.

Similarly, a period detector 346 may be configured as a digital counter for measuring the period $T_P$ of the input dimming pulse $S_{PWMIN}$ using the clock CK. The period data S1 is a count value, and S1=$T_P/T_{CK}$.

The duty ratio detector 344 and the period detector 346 may share the same counter.

The correction part 348 generates output duty ratio data S3 indicating a pulse width $T_{ON}'$ (duty ratio $D_{OUT}$) of the output dimming pulse $S_{PWMOUT}$ according to the input duty ratio data S2.

The reconversion part 350 generates an output dimming pulse $S_{PWMOUT}$ based on the period data S1 and the output duty ratio data S3. The output dimming pulse $S_{PWMOUT}$ has a period $T_P$ represented by the period data S1, and has a pulse width $T_{ON}'$ represented by the output duty ratio data S3. The reconversion part 350 may be configured as a digital counter. The reconversion part 350 sets a count number represented by the output duty ratio data S3, a period in which the clock CK is counted, and the output dimming pulse $S_{PWMOUT}$ to a first level (for example, a high level). Subsequently, the reconversion part 350 sets a count number of (S1−S2), a period in which the clock CK is counted, and the output dimming pulse $S_{PWMOUT}$ to a second level (for example, a low level).

Further, the configurations of the measurement part 342 and the reconversion part 350 are not particularly limited and they may be differently configured. The configuration example of the dimming controller 340 has been described above.

Subsequently, the process of the correction part 348 will be described.

The correction part 348 may select one of (i) the previous output duty ratio data (reference duty ratio data) S4 and (ii) the input duty ratio data S2 to output it as the output duty ratio data S3. The reference duty ratio data S4 corresponds to the pulse width $T_{ON0}$ of FIG. 4B, and the value is referred to as a reference duty ratio $D_{REF}$.

When a change in the input duty ratio $D_{IN}$ is highly likely to result from the jitter or noise, the current input duty ratio data S2 is neglected and the reference duty ratio data S4 is selected as the output duty ratio data S3. Accordingly, the previous output duty ratio is maintained, and thus, the influence of the jitter and noise can be removed from the output duty ratio data D3.

The correction part 348 may include a memory for holding the value $D_{REF}$ of the reference duty ratio data S4. The correction part 348 determines the value $D_{OUT}$ of the output duty ratio data S3 based on a result of the comparison between the value $D_{IN}$ of the current input duty ratio data S2 and the value $D_{REF}$ of the reference duty ratio data S4.

(i) When the number of times of occurrence of the input duty ratio data S2 having the value $D_{IN}$ that satisfies a predetermined condition regarding the value $D_{REF}$ of the reference duty ratio data S4 is smaller than a predetermined number of times B, the correction part 348 maintains the value $D_{OUT}$ of the output duty ratio data S3. Further, (ii) when the number of times of occurrence exceeds the predetermined number of times B, the correction part 348 sets the value $D_{IN}$ of the input duty ratio data S2 to the value $D_{OUT}$ of the new output duty ratio data S3. Further, the correction part 348 updates the value $D_{REF}$ of the memory with the value $D_{IN}$ of the input duty ratio data S2.

In this embodiment, the predetermined condition is that the value $D_{IN}$ of the input duty ratio data S2 is smaller than the value $D_{REF}$ of the reference duty ratio data S4 as follows:

$$D_{IN}<D_{REF}$$

When the duty ratio is large to some extent and the light source emits light brightly, it is difficult for a change in the duty ratio of PWM dimming to be recognized as flickering. Thus, in this situation, there is no need to perform a correction. Accordingly, when the duty ratio $D_{IN}$ of the input dimming pulse $S_{PWMIN}$ is greater than a predetermined threshold value A, the dimming controller 340 may not perform a correction.

Figure 6:
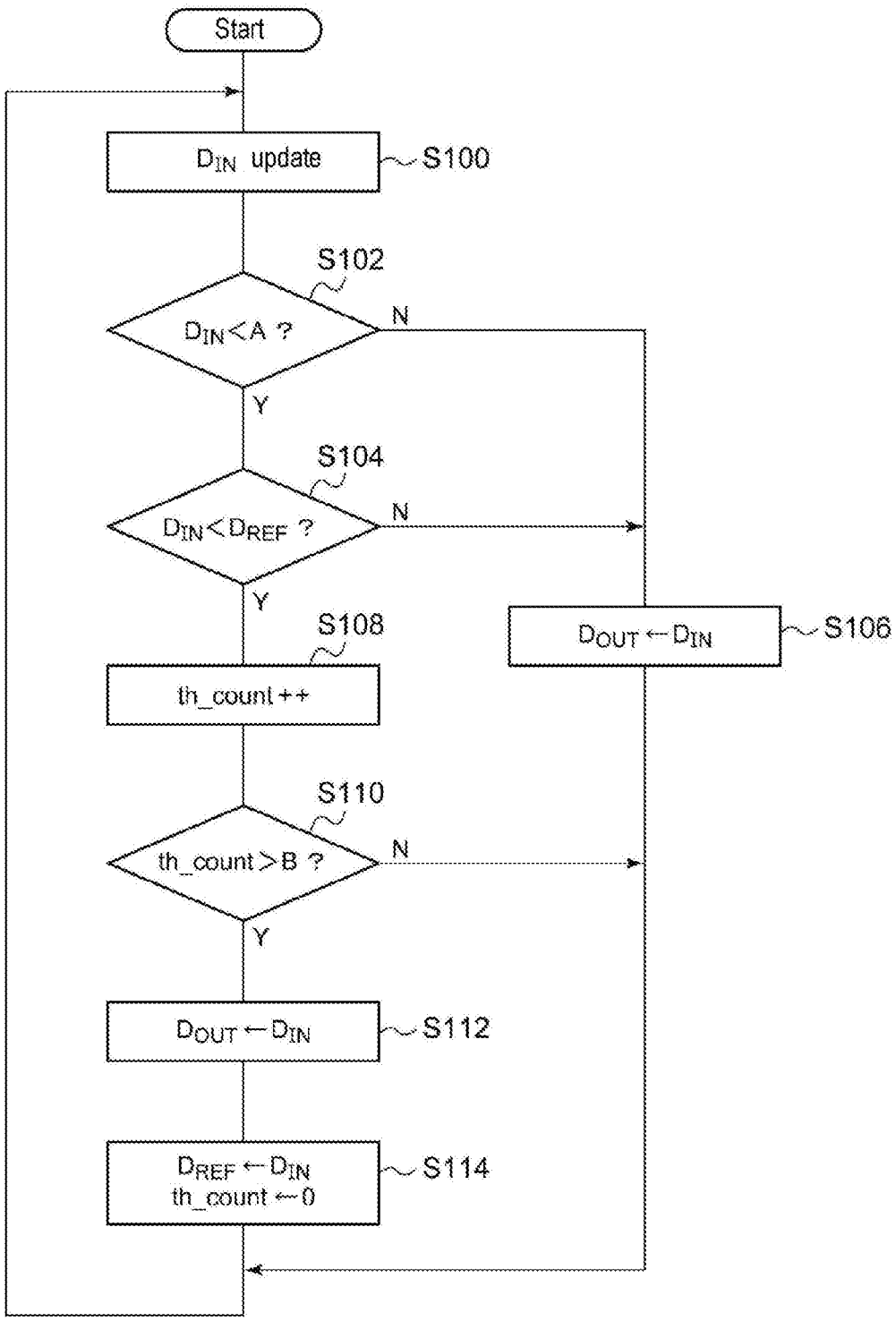
FIG. 6 is a flowchart illustrating correction processing of a duty ratio.

FIG. 6 is a flowchart illustrating a correction processing of a duty ratio. In FIG. 6, the processing of 1 cycle of the input dimming pulse $S_{PWMIN}$ is illustrated. First, a pulse width $T_{ON}$ of the input dimming pulse $S_{PWMIN}$ is measured and the value $D_{IN}$ of the input duty ratio data S2 is updated. Subsequently, the value $D_{IN}$ and the threshold value A are compared (S102). When the value $D_{IN}$ is greater (N in S102), the value $D_{IN}$ of the current input duty ratio data S2 becomes the value $D_{OUT}$ of the new output duty ratio data S3 (S106).

When the value $D_{IN}$ is smaller (Y in S102), the value $D_{IN}$ of the current input duty ratio data S2 is compared with the value $D_{REF}$ of the reference duty ratio data S4 stored in the memory to determine whether the predetermined condition ($D_{IN}<D_{REF}$) is satisfied (S104). When the predetermined conditions is not satisfied ($D_{IN}>D_{REF}$, N in S104), the value $D_{IN}$ of the current input duty ratio data S2 becomes the value $D_{OUT}$ of the new output duty ratio data S3 (S106).

In step S104, when the predetermined condition ($D_{IN}<D_{REF}$) is satisfied (Y in S104), the data th_count indicating the number of times of occurrence th_count is increased (S108). Further, when the number of times of occurrence th_count is smaller than a threshold value B (N in S110), the value $D_{OUT}$ of the output duty ratio data S3 is not updated, and thus, the previous value is maintained.

When the number of times of occurrence th_count exceeds the threshold value B (Y in S110), the value $D_{OUT}$ of the output duty ratio data S3 becomes the value $D_{IN}$ of the input duty ratio data S2 (S112). And then, the value $D_{REF}$ of the reference duty ratio data S4 of the memory is updated with the value $D_{IN}$ of the input duty ratio data S2, and the number of times of occurrence th_count is reset (S114).

According to this processing, when the input duty ratio $D_{IN}$ smaller than the current output duty ratio $D_{OUT}$ is generated, if the number of times of occurrence th_count exceeds the predetermined number B, it may be estimated that the duty ratio has been controlled to be lowered (not lowered due to the jitter or noise).

Flickering caused by the jitter or noise is noticeable particularly in an area with a small duty ratio. Thus, when the input duty ratio $D_{IN}$ is smaller than before, flicking can be appropriately suppressed by counting the number of times.

Figure 7:
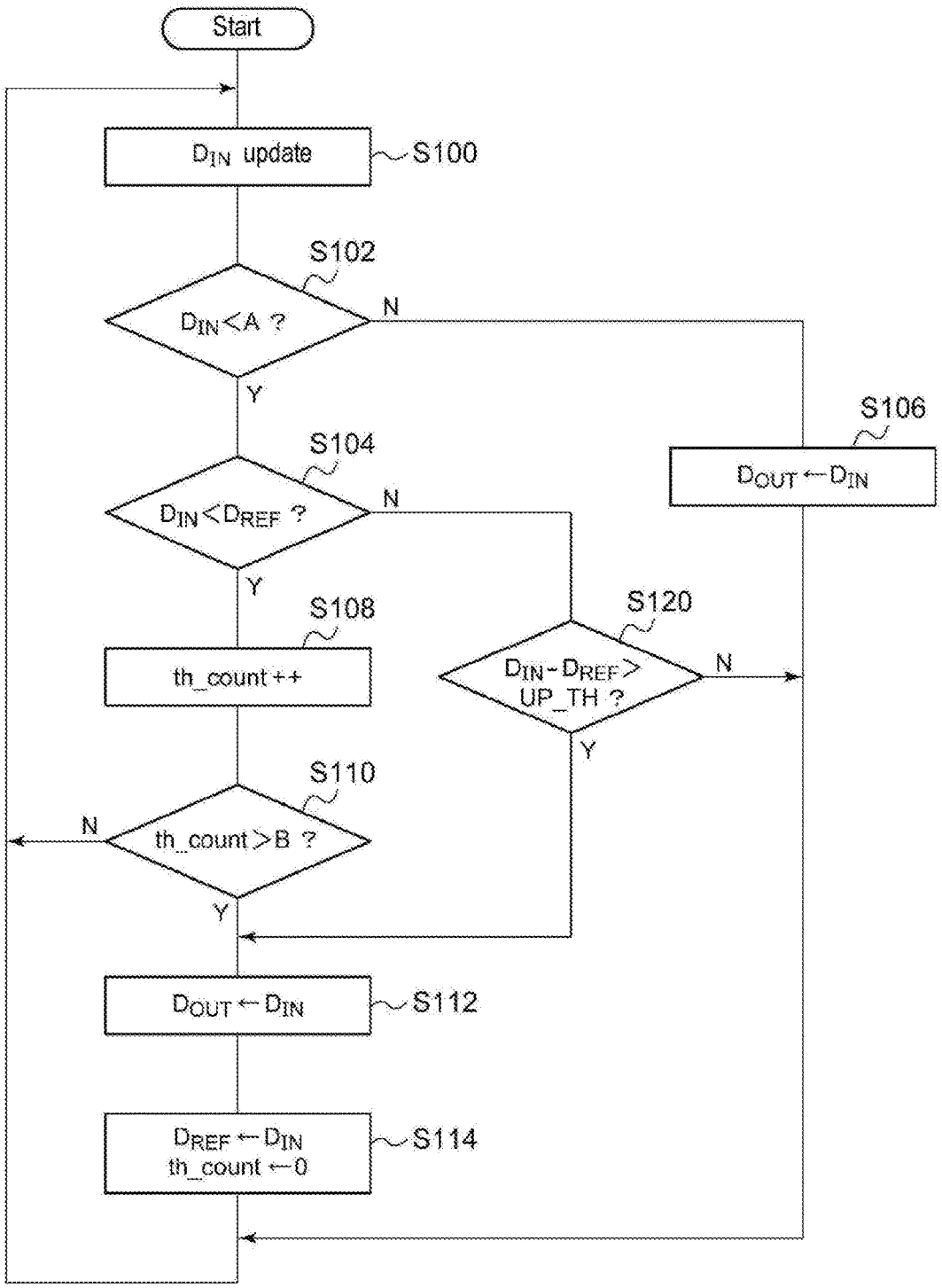
FIG. 7 is a flowchart illustrating improved correction processing.

FIG. 7 is a flowchart illustrating improved correction processing. The correction processing further includes step S120.

In FIG. 7, when the predetermined condition is not satisfied ($D_N > D_{REF}$), the processing is different. When the value $D_{IN}$ is greater than the value $D_{REF}$ based on a result of comparison between the value $D_{IN}$ and the value $D_{REF}$ (N in S104), the process proceeds to step S120. Further, when a difference (increase) ($D_{IN}-D_{REF}$) is greater than a first threshold value UP_TH (Y in S120), the process proceeds to step S112 in which the value $D_{IN}$ of the input duty ratio data S2 becomes the value $D_{OUT}$ of the output duty ratio data D3.

When the difference (increase) ($D_{IN}-D_{REF}$) is smaller than the first threshold value UP_TH (N in S120), the value $D_{OUT}$ of the output duty ratio data S3 is not updated, and thus, the previous value is maintained.

Figure 8:
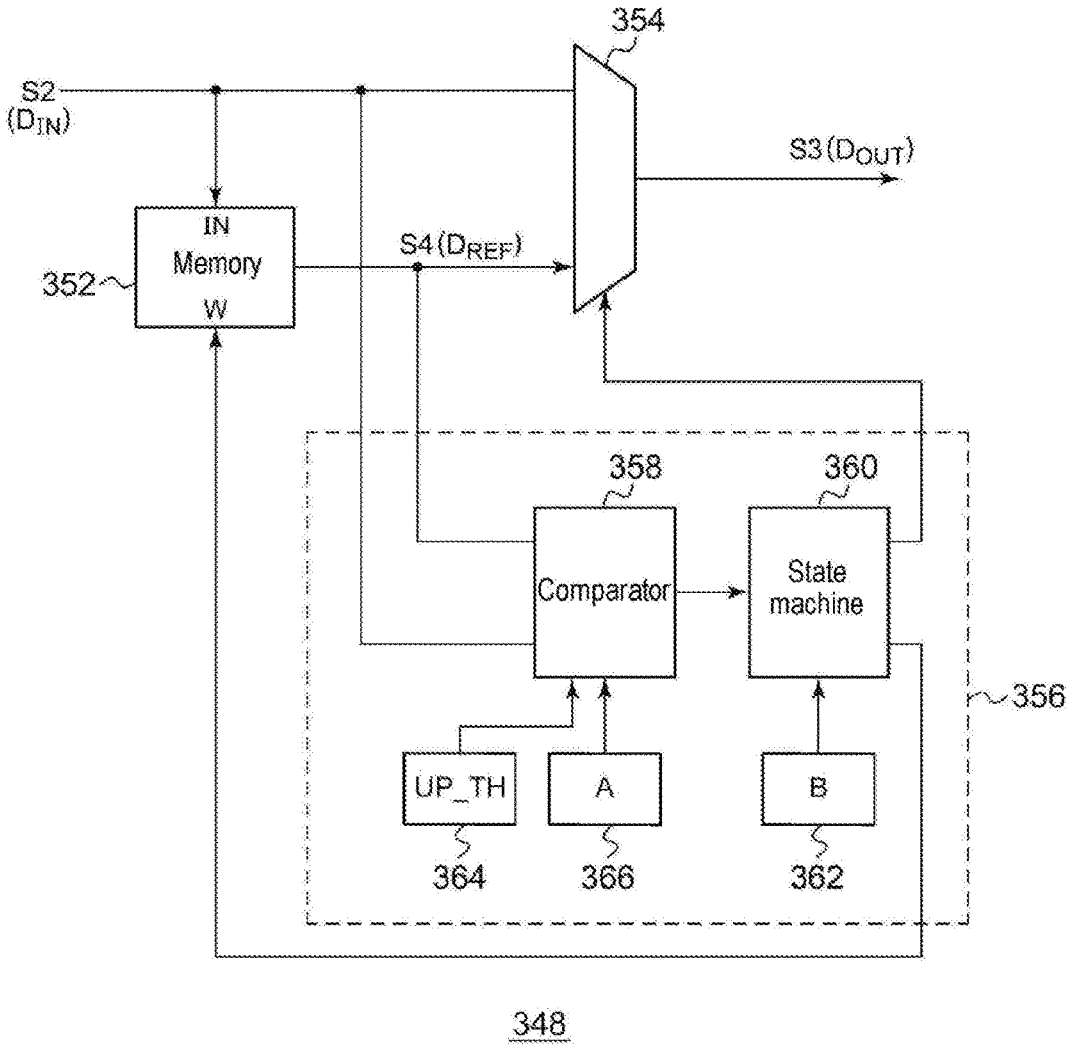
FIG. 8 is a block diagram of a correction part capable of performing the correction processing of FIG. 6 or 7.

FIG. 8 is a block diagram of the correction part 348 capable of performing the correction processing of FIG. 6 or 7. The correction part 348 includes a memory 352, a selector 354, and a correction control part 356. The memory 352 holds the value $D_{REF}$ of the reference duty ratio data S4. The selector 354 selects one of the value $D_{IN}$ of the input duty ratio data S2 and the value $D_{REF}$ of the reference duty ratio data S4 and sets it to the value $D_{OUT}$ of the output duty ratio data S3.

The correction control part 356 controls the memory 352 and the selector 354. The comparator 358 compares the value $D_{IN}$ and the value $D_{REF}$ (S102, S104, and S120). A state machine 360 controls the selector 354 based on the comparison result of the comparator 358, and also controls the writing into the memory 352.

A first register 362 stores first data for setting the predetermined number of times B. A second register 364 stores second data for setting the first threshold value UP_TH. A third register 366 stores third data for setting a second threshold value A.

Since various parameters can be set by the registers, it is possible to set an optimal value for each platform on which the control circuit 300 is used.

Figure 9:
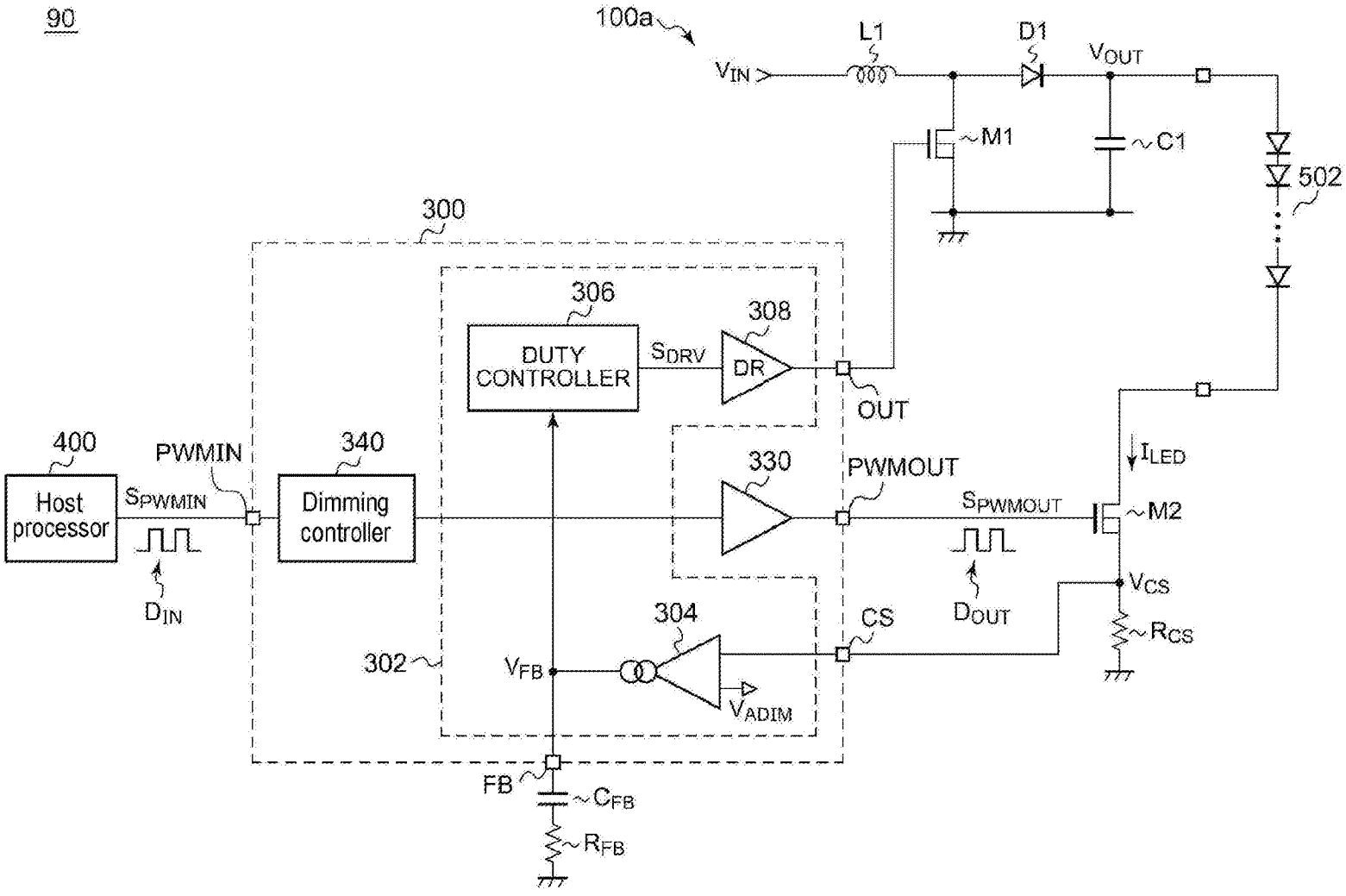
FIG. 9 is a circuit diagram of a constant current converter according to a first configuration example.

FIG. 9 is a circuit diagram of a constant current converter 100*a* according to a first configuration example. The constant current converter 100*a* is a step-up converter (Booster converter), and includes an inductor L1, a switching transistor M1, a rectifying diode D1, and a smoothing capacitor C1. The rectifying diode D1 may be a synchronous rectifying transistor.

A PWM dimming switch M2 and a detection resistor $R_{CS}$ are provided on the path of a driving current $I_{LED}$. A voltage drop of the detection resistor $R_{CS}$ is input to a current detection terminal CS of the control circuit 300. A feedback controller 302 includes an error amplifier 304, a duty controller 306, and a driver 308. The error amplifier 304 amplifies an error between the detection voltage $V_{CS}$ and an analog dimming voltage $V_{ADIM}$ to generate a feedback signal $V_{FB}$. The error amplifier 304 may include a transconductance amplifier, a phase compensation capacitor $C_{FB}$ and a resistor $R_{FB}$. The duty controller 306 generates a driving pulse $S_{DRV}$ of a duty ratio based on the feedback signal $V_{FB}$. The driver 308 switches a switching transistor M1 according to the driving pulse $S_{DRV}$.

A constant current source may be provided instead of the detection resistor $R_{CS}$. In this case, the feedback controller 302 switches the switching transistor M1 such that a voltage across the constant current source is identical to a predetermined reference voltage $V_{REF}$. The PWM dimming switch M2 may be included in the constant current source.

Figure 10:
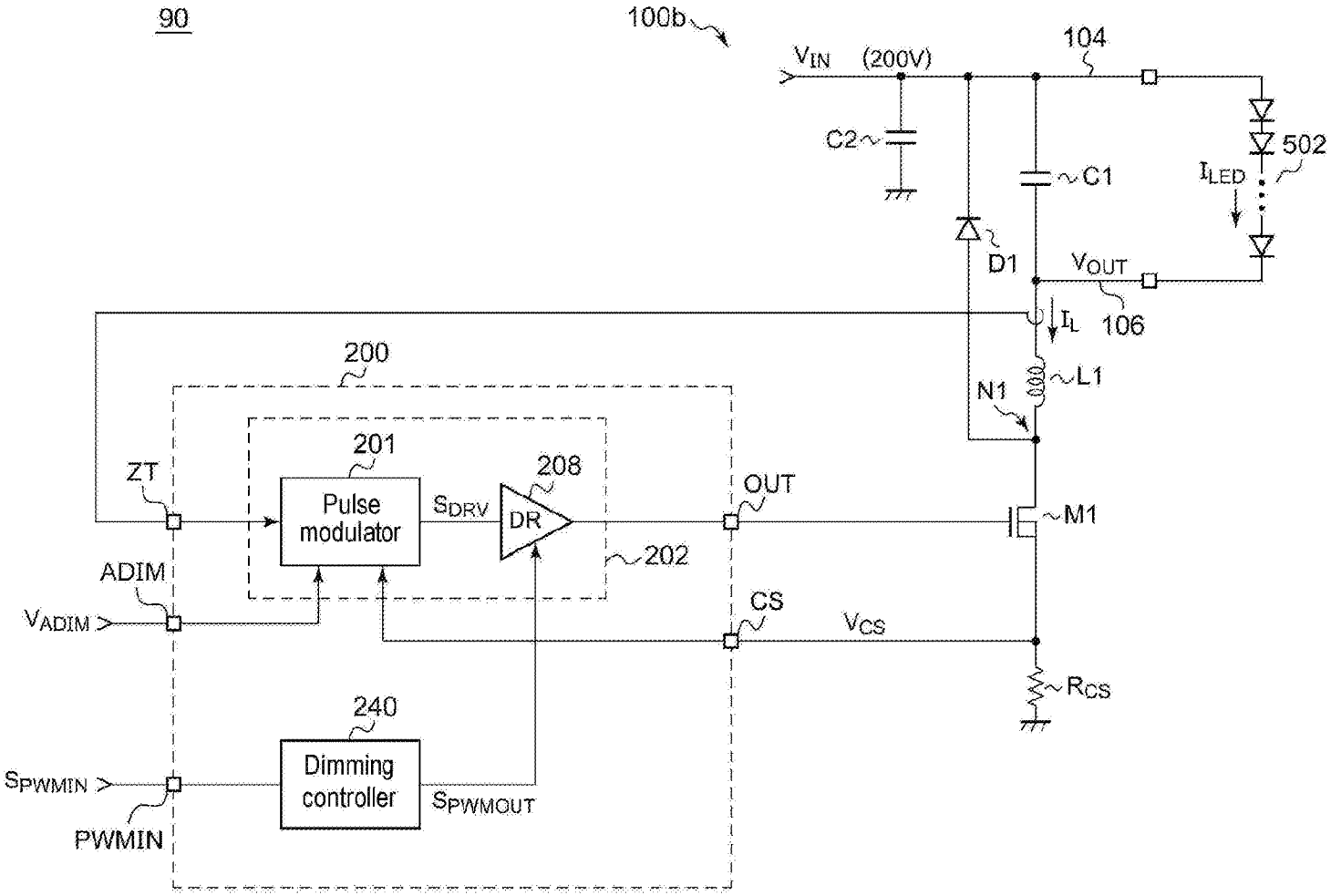
FIG. 10 is a circuit diagram of a constant current converter according to a second configuration example.

FIG. 10 is a circuit diagram of a constant current converter 100*b* according to a second configuration example. The constant current converter 100*b* is a step-down converter (Buck converter) which steps down an input voltage $V_{IN}$ of an input line 104 and outputs the stepped-down output voltage $V_{OUT}$ from an output line 106. One end (anode) of the LED light source 502 is connected to the input line 104, and the other end (cathode) thereof is connected to the output line 106. A driving voltage $V_{IN}-V_{OUT}$ is supplied between both ends of the LED light source 502.

The LED light source 502, which is a device to be driven with a constant current, may be, for example, an LED string including a plurality of light emitting devices (LEDs) connected in series. The constant current converter 100 stabilizes a driving current $I_{LED}$ flowing in the LED light source 502 to a target current $I_{REF}$ corresponding to a target brightness.

An output circuit 102 includes a smoothing capacitor C1, an input capacitor C2, a rectifying diode D1, a switching transistor M1, an inductor L1, and a detection resistor $R_{CS}$. One end of the smoothing capacitor C1 is connected to the input line 104, and the other end of the smoothing capacitor C1 is connected to the output line 106.

One end of the inductor L1 is connected to the output line 106, and the other end of the inductor L1 is connected to a drain of the switching transistor M1. The detection resistor $R_{CS}$ is disposed on the path of a current (inductor current) $I_L$ flowing in the switching transistor M1 and the inductor L1 during an ON period of the switching transistor M1. A cathode of the rectifying diode D1 is connected to the input line 104, and an anode of the rectifying diode D1 is connected to a connection point N1 (drain) of the switching transistor M1 and the inductor L1.

A control circuit 200 is a functional IC integrated on a single semiconductor substrate and includes an output (OUT) terminal, a current detection (CS) terminal, a zero-cross detection (ZT) terminal, a ground (GND) terminal, a pulse dimming input (PWMIN) terminal, and an analog dimming (ADIM) terminal. The GND terminal is grounded. The OUT terminal is connected to a gate of the switching transistor M1, and a detection voltage $V_{CS}$ corresponding to a voltage drop of the detection resistor $R_{CS}$ is input to the CS terminal. The switching transistor M1 may be incorporated in the control circuit 200. An analog dimming voltage $V_{ADIM}$ indicating the inductor current $I_L$ and furthermore, a target amount $I_{REF}$ of a driving current $I_{LED}$, from the host processor 400 (not shown) is input to the ADIM terminal.

The control circuit 200 includes a feedback controller 202 and a dimming controller 340. The feedback controller 202 includes a pulse modulator 201 and a driver 208. The pulse modulator 201 generates a driving pulse $S_{DRV}$ whose duty ratio is adjusted such that a current detection signal $I_S$ based on the detection voltage $V_{CS}$ is close to a current set signal $I_{REF}$ based on the analog dimming voltage $V_{ADIM}$. The driver 208 drives the switching transistor M1 of the constant current converter 100*a* based on the driving pulse $S_{DRV}$.

An input dimming pulse $S_{PWMIN}$ having an input duty ratio $D_{IN}$ is input to the PWMIN terminal. Upon receipt of the input dimming pulse $S_{PWMIN}$, the dimming controller 340 generates an output dimming pulse $S_{PWMOUT}$. The dimming controller 340 is the same as described above.

In this constant current converter 100*b*, the switching transistor M1 serves as a PWM dimming switch. The driver 208 switches the switching transistor M1 during a period in which the output dimming pulse $S_{PWMOUT}$ is in an ON level (for example, a high level), and stops the switching during a period in which the output dimming pulse $S_{PWMOUT}$ is in an OFF level (for example, a low level). The output dimming pulse $S_{PWMOUT}$ may be input to the pulse modulator 201. In this case, the pulse modulator 201 may fix the driving pulse $S_{DRV}$ to a low level during a period in which the output dimming pulse $S_{PWMOUT}$ is in an OFF level.

It is to be understood by those skilled in the art that the embodiments are merely illustrative and may be variously modified by any combination of the components or processes, and the modifications are also within the scope of the present disclosure. Hereinafter, these modifications will be described.

(First Modification)

In the embodiment, regarding the correction processing of the correction part 348 illustrated in FIG. 6 or 7, the predetermined condition is set to $D_N<D_{REF}$, but the present disclosure is not limited thereto. A predetermined value D may be defined and the predetermined condition determined in step S104 may be set as follows:

$$D_{IN}<D_{REF}-D$$

In this case, the sensitivity to jitter or noise may be adjusted based on the predetermined value D.

(Second Modification)

Figure 11:
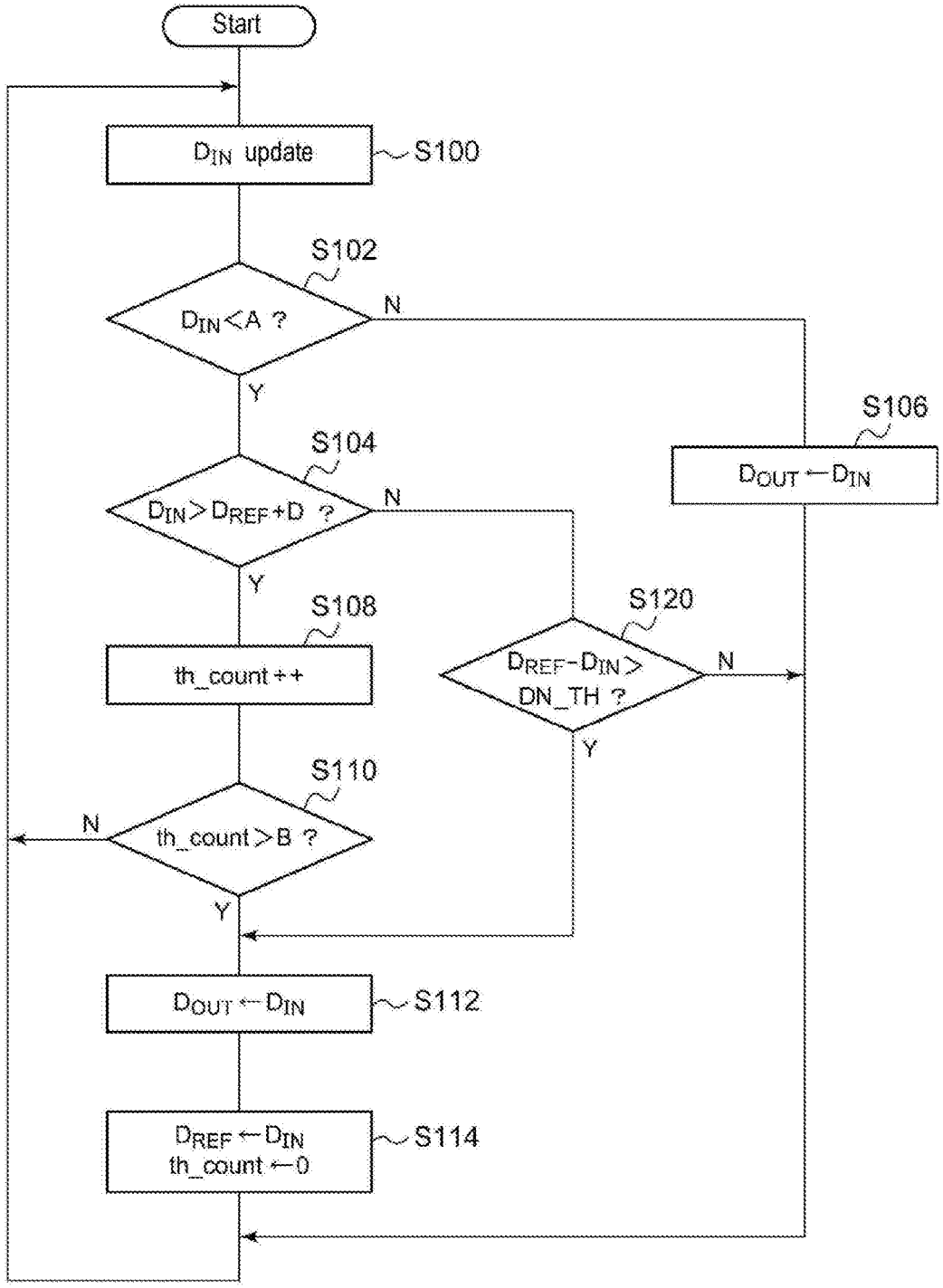
FIG. 11 is a flow chart illustrating correction processing according to a second modification.

FIG. 11 is a flowchart illustrating correction processing according to a second modification. The predetermined condition of step S104 is as follows:

$$D_{IN}>D_{REF}+D$$

A relationship regarding the size is opposite to that of the first modification, and a condition of the second modification is that the value $D_{IN}$ of the input duty ratio data S2 is greater than the value $D_{REF}$ of the reference duty ratio data S4 by a predetermined value E or greater.

Further, in step S120, (iii-1) when the value $D_{IN}$ of the input duty ratio data S2 is smaller than the value $D_{REF}$ of the reference duty ratio data S4 and when a difference $D_{REF}$-$D_{IN}$ between the value $D_{REF}$ of the reference duty ratio data S4 and the value $D_{IN}$ of the input duty ratio data S2 is greater than the first threshold value DN_TH (Y in S120), the input duty ratio data S2 is set to new output duty ratio data S3, and when (iii-2) the difference $D_{REF}-D_N$ is smaller than the first threshold value DN_TH (N in S120), the output duty ratio data is maintained.

(Third Modification)

Alternatively, the predetermined condition determined in step S104 of the flowchart of FIG. 11 may be simplified as follows:

$$D_{IN}>D_{REF}$$

(Fourth Modification)

In the embodiment, the case in which the LED light source 502 is an LED string has been described, but the type of the load is not particularly limited and the present disclosure may also be applied to various different loads to be driven with a constant current, as well as to the light source.

(Fifth Modification)

In this embodiment, the setting of a logic value of a high level or a low level of a logic circuit may be an example and may be freely changed by appropriately inverting the values by an inverter, or the like.

(Applications)

Figure 12:
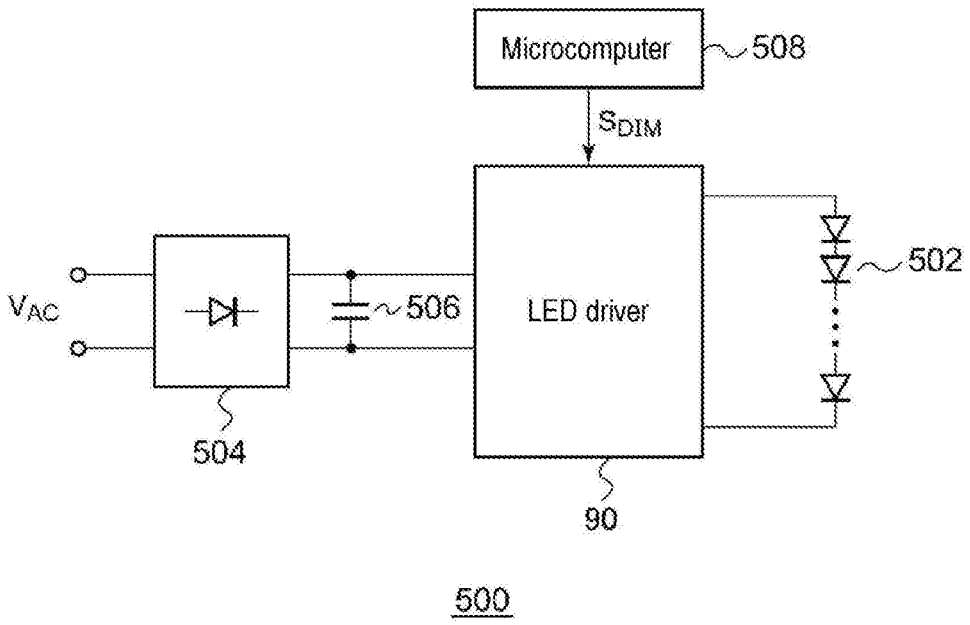
FIG. 12 is a block diagram of a lighting apparatus using an LED driver.

Finally, the applications of the constant current converter 100 will be described. FIG. 12 is a block diagram of a lighting apparatus 500 using an LED driver 90. The lighting apparatus 500 includes a rectifying circuit 504, a smoothing capacitor 506, and a microcomputer 508, in addition to a light emitting part as the LED light source 502 and the LED driver 90. The rectifying circuit 504 and the smoothing capacitor 506 rectify and smooth a commercial AC voltage $V_{AC}$ to convert the voltage into a DC voltage $V_{DC}$. The microcomputer 508 generates a control signal $S_{DIM}$ indicating the brightness of the LED light source 502. The LED driver 90 receives the DC voltage $V_{DC}$ as an input voltage $V_{IN}$ and supplies a driving current $I_{LED}$ according to the control signal $S_{DIM}$ to the LED light source 502. The control signal $S_{DIM}$ includes the analog dimming voltage $V_{ADIM}$ and the dimming pulse $S_{PWMIN}$ described above.

Figure 13A:
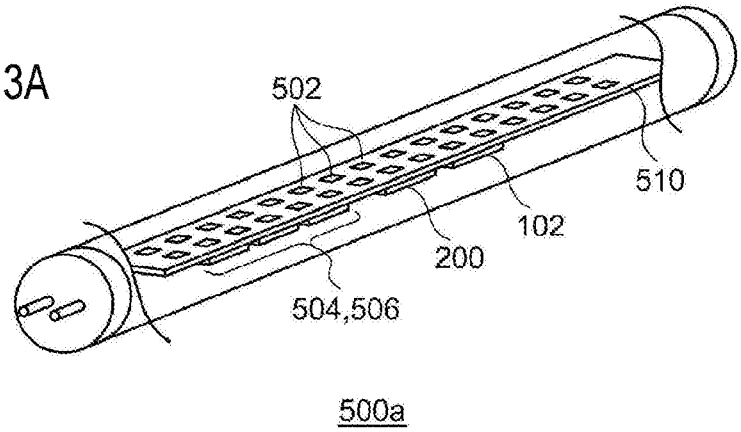
FIGS. 13A to 13C are views illustrating specific examples of a lighting apparatus.
Figure 13B:
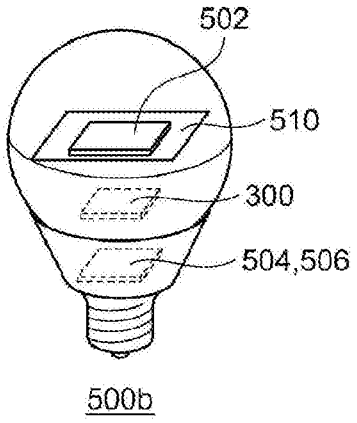
Figure 13C:
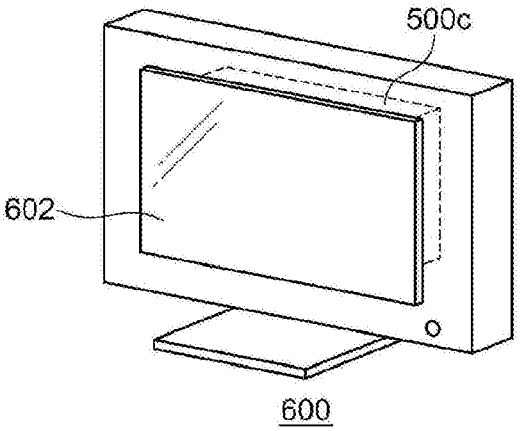

FIGS. 13A to 13C are views illustrating specific examples of the lighting apparatus 500. In FIGS. 13A to 13C, all the components are not shown and some of them are omitted. A lighting apparatus 500*a* of FIG. 13A is a tubular LED lighting. A plurality of LED devices constituting an LED string as the LED light source 502 are arranged on a board 510. A rectifying circuit 504, a control circuit 200, the output circuit 102 of the constant current converter 100, and the like are mounted on the board 510. The output circuit 102 includes an inductor L1, a switching transistor M1, a rectifying diode D1, and a smoothing capacitor C1.

A lighting apparatus 500*b* of FIG. 13B is a bulb-type LED lighting. An LED module as the LED light source 502 is mounted on a board 510. A control circuit 200 and a rectifying circuit 504 are mounted within the housing of the lighting apparatus 500*b*.

A lighting apparatus 500*c* of FIG. 13C is a backlight incorporated in a liquid crystal display (LCD) 600. The lighting apparatus 500*c* irradiates the back surface of a liquid crystal panel 602.

Alternatively, the lighting apparatus 500 may be used for ceiling lights. In this manner, the lighting apparatus 500 of FIG. 12 may be used for various applications.

According to the present disclosure in some embodiments, it is possible to reduce the flickering of PWM dimming.

While certain embodiments have been described, these embodiments have been presented by way of example only, and are not intended to limit the scope of the disclosures. Indeed, the embodiments described herein may be embodied in a variety of other forms; furthermore, various omissions, substitutions and changes in the form of the embodiments described herein may be made without departing from the spirit of the disclosures. The accompanying claims and their equivalents are intended to cover such forms or modifications as would fall within the scope and spirit of the disclosures.

What is claimed is:

1. A control circuit of a driving circuit for supplying a driving current to a light source, comprising:

a pulse width modulation (PWM) input terminal configured to receive an input dimming pulse having an input duty ratio corresponding to a target light quantity of the light source, the input dimming pulse being pulse-width modulated; and a dimming controller configured to convert a period and a pulse width of the input dimming pulse into digital values, reconvert the digital values into an output dimming pulse having an output duty ratio which is the same as or different from the input duty ratio, and control the driving current to be on and off based on the output dimming pulse, wherein the dimming controller comprises:

a measurement part configured to measure the period and the pulse width of the input dimming pulse to generate a period data representing the period and an input duty ratio data representing the pulse width;

a correction part configured to generate an output duty ratio data based on the input duty ratio data; and a reconversion part configured to generate the output dimming pulse based on the period data and the output duty ratio data, wherein one of (i) a previous output duty ratio data which is previously generated by the correction part and (ii) the input duty ratio data is selected as the output duty ratio data, wherein the correction part comprises a memory configured to hold the previous output duty ratio data as reference duty ratio data, and is configured to generate the output duty ratio data based on a result of comparison between the input duty ratio data and the reference duty ratio data, and wherein the correction part is configured to (i) maintain the output duty ratio data when the number of times of occurrence of the input duty ratio data that satisfies a predetermined condition regarding the reference duty ratio data is smaller than a predetermined number of times, and (ii) update the memory based on the input duty ratio data by setting the input duty ratio data as a new output duty ratio data when the number of times of occurrence exceeds the predetermined number of times.

2. The control circuit of claim 1, wherein the predetermined condition is that the input duty ratio data is smaller than the reference duty ratio data.

3. The control circuit of claim 1, wherein the predetermined condition is that the input duty ratio data is smaller than the reference duty ratio data by a predetermined value or greater.

4. The control circuit of claim 2, wherein the correction part is configured to set (iii) the input duty ratio data as the new output duty ratio data when the input duty ratio data is greater than the reference duty ratio data.

5. The control circuit of claim 2, wherein the correction part is configured to (iii-1) set the input duty ratio data as the new output duty ratio data when the input duty ratio data is greater than the reference duty ratio data and a difference between the reference duty ratio data and the input duty ratio data is greater than a first threshold value, and (iii-2) maintain the output duty ratio data when the input duty ratio data is greater than the reference duty ratio data and the difference is smaller than the first threshold value.

6. The control circuit of claim 1, wherein the predetermined condition is that the input duty ratio data is greater than the reference duty ratio data.

7. The control circuit of claim 1, wherein the predetermined condition is that the input duty ratio data is greater than the reference duty ratio data by a predetermined value or greater.

8. The control circuit of claim 6, wherein the correction part is configured to set (iii) the input duty ratio data as the new output duty ratio data when the input duty ratio data is smaller than the reference duty ratio data.

9. The control circuit of claim 6, wherein the correction part is configured to (iii-1) set the input duty ratio data as the new output duty ratio data when the input duty ratio data is smaller than the reference duty ratio data and a difference between the reference duty ratio data and the input duty ratio data is greater than a first threshold value, and (iii-2) maintain the output duty ratio data when the input duty ratio data is smaller than the reference duty ratio data and the difference is smaller than the first threshold value.

10. The control circuit of claim 1, further comprising a first register configured to store first data for setting the predetermined number of times.

11. The control circuit of claim 5, further comprising a second register configured to store second data for setting the first threshold value.

12. The control circuit of claim 1, wherein the dimming controller is configured not to perform a correction when the input duty ratio of the input dimming pulse is greater than a predetermined second threshold value.

13. The control circuit of claim 12, further comprising a third register configured to store third data for setting the second threshold value.

14. The control circuit of claim 1, wherein the driving circuit comprises a constant current converter, and the control circuit further comprises a feedback controller configured to control the constant current converter.

15. The control circuit of claim 1, wherein the control circuit is integrated on a single semiconductor substrate.

16. A driving circuit of a light source, comprising:

a constant current converter; and the control circuit of claim 1.

17. A lighting apparatus, comprising:

a lighting emitting diode (LED) light source including a plurality of LEDs connected in series;

a rectifying circuit configured to smooth and rectify a commercial AC voltage;

a constant current converter configured to receive a DC voltage smoothed and rectified by the rectifying circuit as an input voltage and set the LED light source as a load; and the control circuit of claim 1.

18. An electronic device, comprising:

a liquid crystal panel; and the lighting apparatus of claim 17, which is a backlight configured to irradiate the liquid crystal panel from a backside of the liquid crystal panel.

19. A method for driving a light source, comprising:

converting a period and a pulse width of an input dimming pulse having an input duty ratio into digital values;

reconverting the digital values into an output dimming pulse having an output duty ratio which is the same as or different from the input duty ratio; and switching a PWM dimming switch which is responsive to the output dimming pulse and is arranged on a path of a driving current flowing in the light source or an inductor current flowing in an inductor of a constant current converter, wherein the act of reconverting the digital values into the output dimming pulse includes:

measuring the period and the pulse width of the input dimming pulse to generate period data representing the period and input duty ratio data representing the pulse width;

generating output duty ratio data based on the input duty ratio data; and generating the output dimming pulse based on the period data and the output duty ratio data, wherein one of (i) a previous output duty ratio data which is previously generated and (ii) the input duty ratio data is selected as the output duty ratio data, wherein the previous output duty ratio data is held as reference duty ratio data in a memory, and wherein the act of generating the output duty ratio data includes generating the output duty ratio data based on a result of comparison between the input duty ratio data and the reference duty ratio data, and wherein the act of generating the output duty ratio data further includes (i) maintaining the output duty ratio data when the number of times of occurrence of the input duty ratio data that satisfies a predetermined condition regarding the reference duty ratio data is smaller than a predetermined number of times, and (ii) updating the memory based on the input duty ratio data by setting the input duty ratio data as new output duty ratio data when the number of times of occurrence exceeds the predetermined number of times.

* * * * *